US010584550B2

(12) United States Patent
Delmar et al.

(10) Patent No.: US 10,584,550 B2
(45) Date of Patent: Mar. 10, 2020

(54) SPONGE PRESSURE EQUALIZATION SYSTEM

(71) Applicant: Halliburton Energy Services, Inc., Houston, TX (US)

(72) Inventors: Ludovic Delmar, Brussels (BE); Khac Nguyen Che, Brussels (BE); Aurelien Chauviere, Brussels (BE)

(73) Assignee: Halliburton Energy Services, Inc., Houston, TX (US)

( * ) Notice: Subject to any disclaimer, the term of this patent is extended or adjusted under 35 U.S.C. 154(b) by 889 days.

(21) Appl. No.: 14/911,808

(22) PCT Filed: Sep. 13, 2013

(86) PCT No.: PCT/US2013/059700

§ 371 (c)(1),
(2) Date: Feb. 12, 2016

(87) PCT Pub. No.: WO2015/038143

PCT Pub. Date: Mar. 19, 2015

(65) Prior Publication Data

US 2016/0194928 A1 Jul. 7, 2016

(51) Int. Cl.

| | |
|---|---|
| ***E21B 25/06*** | (2006.01) |
| ***E21B 49/08*** | (2006.01) |
| *E21B 49/10* | (2006.01) |
| *E21B 25/08* | (2006.01) |

(52) U.S. Cl.
CPC ..... *E21B 25/06* (2013.01); *E21B 49/081* (2013.01); *E21B 25/08* (2013.01); *E21B 49/10* (2013.01)

(58) Field of Classification Search
CPC ..... E21B 25/00; E21B 25/06; E21B 25/08; E21B 49/081; E21B 49/10
See application file for complete search history.

(56) References Cited

U.S. PATENT DOCUMENTS

| | | | | |
|---|---|---|---|---|
| 4,312,414 | A | 1/1982 | Park | |
| 4,479,557 | A | 10/1984 | Park et al. | |
| 4,502,553 | A | 3/1985 | Park et al. | |
| 4,598,777 | A * | 7/1986 | Park | E21B 25/08 175/226 |

(Continued)

FOREIGN PATENT DOCUMENTS

| | | |
|---|---|---|
| CN | 1987045 | 6/2007 |
| CN | 101251010 | 8/2008 |
| CN | 202596725 | 12/2012 |

OTHER PUBLICATIONS

Office Action received for Canadian Patent Application No. 2919876, dated Dec. 19, 2016; 4 pages.

(Continued)

*Primary Examiner* — Robert E Fuller
*Assistant Examiner* — Christopher J Sebesta
(74) *Attorney, Agent, or Firm* — Baker Botts, L.L.P.

(57) ABSTRACT

A system for obtaining a core sample from a wellbore includes a housing having a core opening at a first end of the housing and an end wall at a second end of the housing. A balancing piston is positioned within the housing to define a sample chamber between the balancing piston and the core opening. An equalization chamber is defined between the balancing piston and the end wall. A core piston is sealingly positioned in the core opening.

20 Claims, 11 Drawing Sheets

(56) References Cited

U.S. PATENT DOCUMENTS

| | | | | |
|---|---|---|---|---|
| 4,716,974 | A | 1/1988 | Radford et al. | |
| 4,735,269 | A | 4/1988 | Park et al. | |
| 4,787,983 | A | 11/1988 | DiFoggio et al. | |
| 5,439,065 | A | 8/1995 | Georgi | |
| 5,687,791 | A | 11/1997 | Beck et al. | |
| 6,164,389 | A * | 12/2000 | Fanuel | E21B 25/00 175/20 |
| 6,216,782 | B1 | 4/2001 | Skinner | |
| 6,216,804 | B1 * | 4/2001 | Aumann | E21B 25/08 175/17 |
| 6,659,204 | B2 | 12/2003 | Aumann et al. | |
| 6,688,390 | B2 | 2/2004 | Bolze et al. | |
| 6,695,075 | B2 | 2/2004 | Beeker | |
| 6,719,070 | B1 * | 4/2004 | Puymbroeck | E21B 25/06 175/20 |
| 7,004,265 | B2 | 2/2006 | Puymbroeck et al. | |
| 7,093,676 | B2 | 8/2006 | Puymbroeck et al. | |
| 7,124,841 | B2 | 10/2006 | Wada et al. | |
| 7,231,991 | B2 | 6/2007 | Puymbroeck et al. | |
| 7,234,547 | B2 | 6/2007 | Puymbroeck et al. | |
| 7,343,984 | B2 | 3/2008 | Masui et al. | |
| 8,162,080 | B2 | 4/2012 | Castillo | |
| 2003/0089526 | A1 * | 5/2003 | Beeker | E02D 1/04 175/58 |
| 2004/0084216 | A1 | 5/2004 | Puymbroeck et al. | |
| 2005/0133258 | A1 | 6/2005 | Veneruso | |
| 2005/0133267 | A1 * | 6/2005 | Reid, Jr. | E21B 25/06 175/58 |
| 2012/0234607 | A1 * | 9/2012 | Kinsella | E21B 25/02 175/403 |
| 2013/0199847 | A1 * | 8/2013 | Delmar | E21B 25/00 175/44 |

OTHER PUBLICATIONS

Office Action received for Chinese Patent Application No. 2013800785890, dated Jan. 24, 2018; 15 pages.

International Preliminary Report on Patentability for PCT Patent Application No. PCT/US2013/059700, dated Mar. 24, 2016; 8 pages.

Examination Report under section 18(3) received for Great Britain Patent Application No. GB1601005.0, dated Apr. 29, 2016; 1 page.

International Search Report and Written Opinion, Application No. PCT/US2013/059700; 12 pages, dated May 28, 2014.

* cited by examiner

SPONGE PRESSURE EQUALIZATION SYSTEM

RELATED APPLICATION

This application is a U.S. National Stage Application of International Application No. PCT/US2013/059700 filed Sep. 13, 2013, which designates the United States, and which is incorporated herein by reference in its entirety.

BACKGROUND

1. Field of the Invention

The present disclosure relates generally to the drilling of a well for recovery of subterranean deposits and more specifically to methods and systems for obtaining a core sample from the well during or subsequent to the drilling process.

2. Description of Related Art

Wells are drilled at various depths to access and produce oil, gas, minerals, and other naturally-occurring deposits from subterranean geological formations. Hydrocarbons may be produced through a wellbore traversing the subterranean formations. While drilling the wellbore, it is sometimes desirable to obtain a geological sample of the substrate through which the wellbore passes. One method for collecting a core sample includes delivering a coring assembly downhole to cut and remove a portion of the substrate within the coring assembly. While it is desired to protect and prevent contamination of the coring sample, doing so is difficult due to the magnitude of downhole fluid pressures and the tendency of such pressures to contaminate the coring assembly and the coring sample.

DETAILED DESCRIPTION OF ILLUSTRATIVE EMBODIMENTS

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The embodiments described herein relate to systems, tools, and methods for obtaining an uncontaminated core sample from a wellbore. More specifically, core sample tool and system are disclosed herein that allow a balancing or communication of pressures within a sample chamber relative to fluid pressures within the wellbore. By closely matching the pressures of the wellbore fluid with that of fluid in the sample chamber, ingress of wellbore fluid and other contaminants into the sample chamber during trip in are prevented.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to". Unless otherwise indicated, as used throughout this document, "or" does not require mutual exclusivity.

As used herein, the phrases "hydraulically coupled," "hydraulically connected," "in hydraulic communication," "fluidly coupled," "fluidly connected," and "in fluid communication" refer to a form of coupling, connection, or communication related to fluids, and the corresponding flows or pressures associated with these fluids. In some embodiments, a hydraulic coupling, connection, or communication between two components describes components that are associated in such a way that fluid pressure may be transmitted between or among the components. Reference to a fluid coupling, connection, or communication between two components describes components that are associated in such a way that a fluid can flow between or among the components. Hydraulically coupled, connected, or communicating components may include certain arrangements where fluid does not flow between the components, but fluid pressure may nonetheless be transmitted such as via a diaphragm or piston.

Figure 1A:
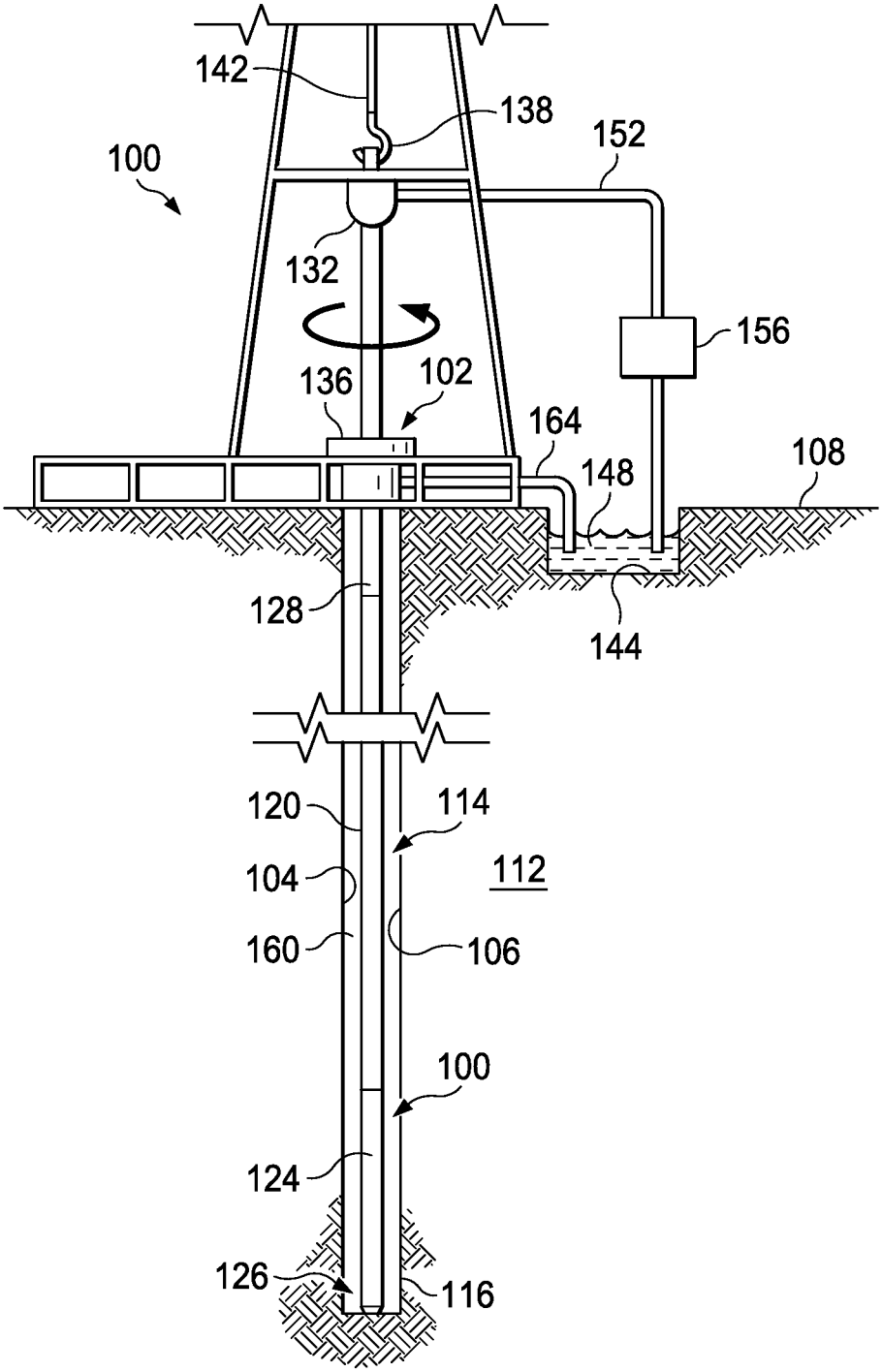
FIG. 1A illustrates a schematic view of a well having a system for obtaining a core sample from the well according to an illustrative embodiment.
Figure 1B:
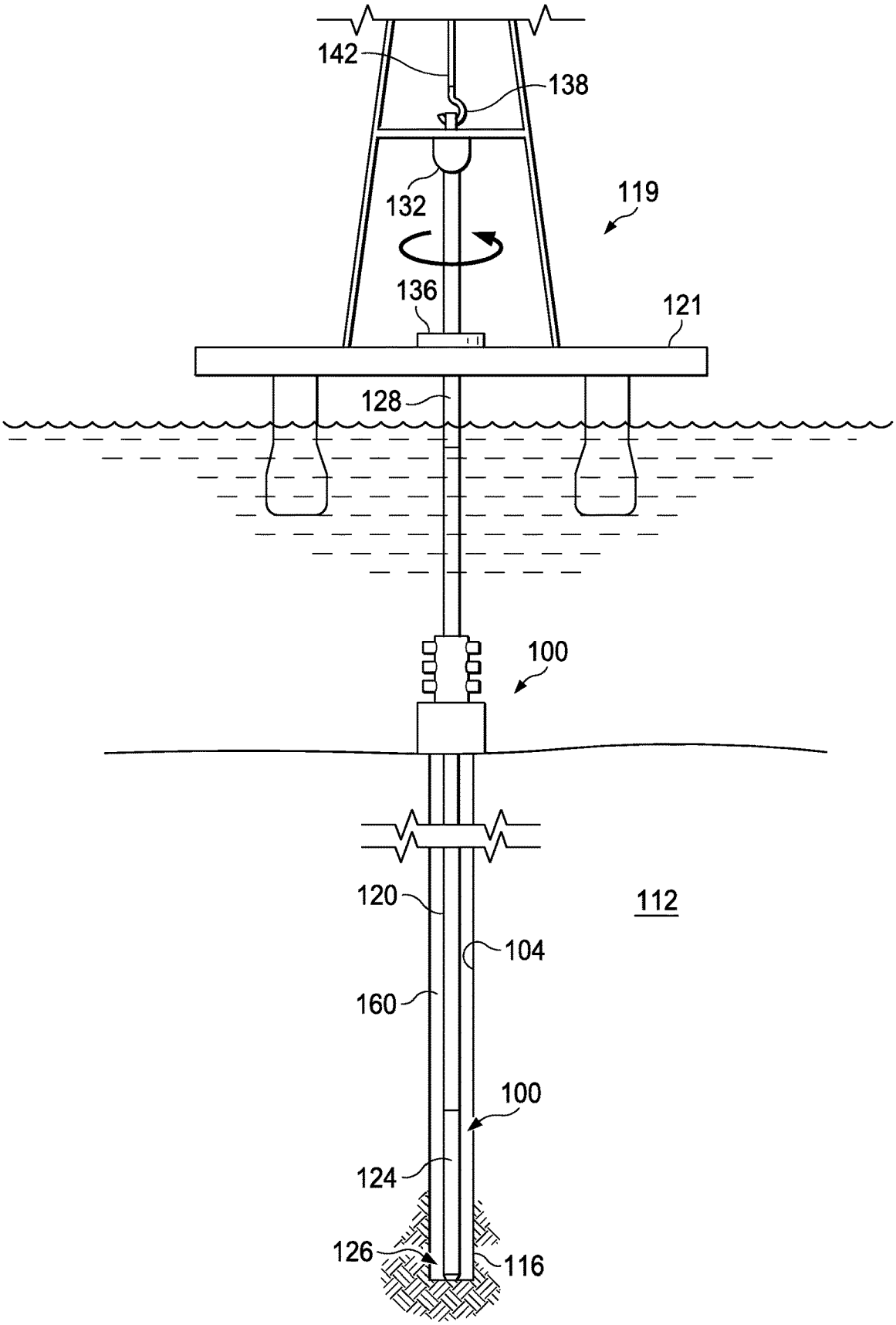
FIG. 1B illustrates a schematic view of an off-shore well having a system for obtaining a core sample from the well according to an illustrative embodiment.

Referring to FIG. 1A, a system 100 for obtaining a core sample of a subterranean substrate or formation 112 according to an illustrative embodiment is deployed in a well 102 having a wellbore 104 that extends from a surface 108 of the well to or through a subterranean formation. The well 102 is illustrated onshore in FIG. 1A. Alternatively, as illustrated in FIG. 1B, the system 100 may be deployed in a sub-sea well 119 accessed by a fixed or floating platform 121. FIGS. 1A-1B each illustrate possible uses or deployments of the system 100, and while the following description of the system 100 focusses primarily on the use of the system 100 during or subsequent to the drilling process, the system 100 may be used instead in any stage of well development, including without limitation the exploration, drilling, completion, or production stages, or in other stages of the well where is may be desirable to obtain a core sample from the well.

In the embodiment illustrated in FIG. 1A, the wellbore 104 has been formed by a drilling process, and many of the components of a drilling system are used to deploy the system 100. While a drill bit (not shown) has been removed or "tripped" from the wellbore 104, a drill string, or another tubing string 120 may be deployed in the wellbore 104 to turn a core sample tool 124 at a downhole location 126 in the wellbore 104. The tubing string 120 extends from the downhole location 126 to the surface 108 of the well 102 and may be made up of one or more connected tubes or pipes of varying or similar cross-section. The tubing string may refer to the collection of pipes or tubes as a single component, or alternatively to the individual pipes or tubes that comprise the string. The term tubing string (or drill string or string) is not meant to be limiting in nature and may refer to any component or components that are capable of transferring rotational energy from the surface of the well to the core sample tool 124. In several embodiments, the tubing string 120 may include a central passage disposed longitudinally in the tubing string and capable of allowing fluid communication between the surface of the well 102 and the downhole location 126.

At or near the surface 108 of the well, the tubing string 120 may include or be coupled to a kelly 128. The kelly 128 may have a square, hexagonal or octagonal cross-section. The kelly 128 is connected at one end to the remainder of the tubing string and at an opposite end to a rotary swivel 132. The kelly 128 passes through a rotary table 136 that is capable of rotating the kelly 128, the remainder of the tubing string 120, and the core sample tool 124. The rotary swivel 132 allows the kelly 128 to rotate without rotational motion being imparted to the rotary swivel 132. A hook 138, cable 142, traveling block (not shown), and hoist (not shown) are provided to lift or lower the core sample tool 124, tubing string 120, kelly 128 and rotary swivel 132. The kelly 128 and swivel 132 may be raised or lowered as needed to add additional sections of tubing to the tubing string 120 as the core sample tool 124 advances, or to remove sections of tubing from the tubing string 120 when removal of the tubing string 120 and core sample tool 124 from the well 102 is desired.

A reservoir 144 is positioned at the surface 108 and holds drilling mud 148 for delivery to the well 102 during drilling and coring operations. A supply line 152 is fluidly coupled between the reservoir 144 and the inner passage of the tubing string 120. A pump 156 drives fluid through the supply line 152 and downhole to lubricate the core sample tool 124 during coring and collection of the core sample. The mud may also be used to carry cuttings or debris from the drilling or coring processes back to the surface 108. After traveling downhole, the drilling mud 148 returns to the surface 108 by way of an annulus 160 formed between the tubing string 120 and the wellbore 104. At the surface 108, the drilling mud 148 is returned to the reservoir 144 through a return line 164. The drilling mud 148 may be filtered or otherwise processed prior to recirculation through the well 102.

Figure 2:
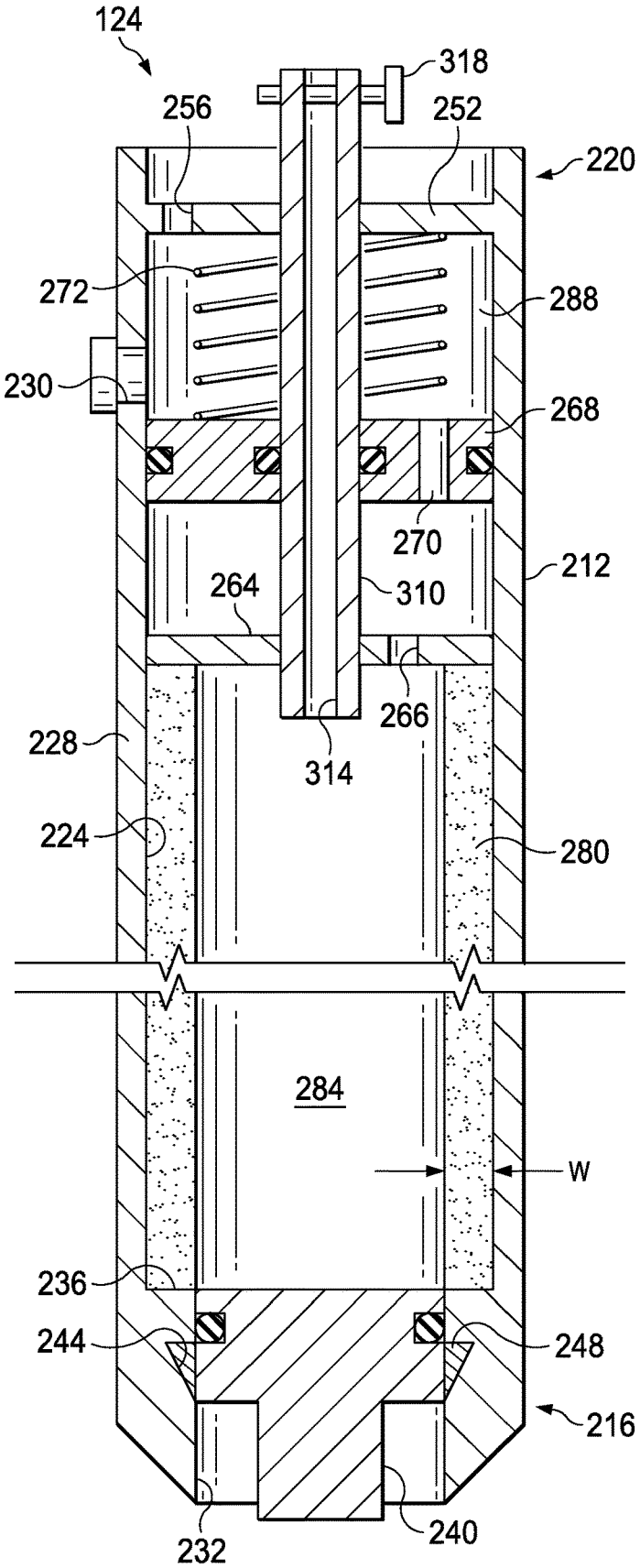
FIG. 2 illustrates a cross-sectional front view of a core sample tool according to an illustrative embodiment.

FIG. 2 illustrates a cross-sectional front view of the core sample tool 124 discussed in FIGS. 1A and 1B. The core sample tool 124, which is a component of system 100, includes a housing 212 having a first end 216 and a second end 220. The housing 212 in some embodiments may be a tubing member. While many cross-sectional shapes may be suitable for the housing 212, in some embodiments, the cross-sectional shape may be circular. The housing 212 may include a passage 224 extending between the first end 216 and the second end 220. The passage 224 may be similar in cross-sectional shape to the cross-sectional shape of the housing 212, and multiple cross-sectional shapes are suitable. In some embodiments, the cross-sectional shape of the passage 224 is circular. The housing may include a wall 228 and within the wall a selectively sealable aperture, or pressure release aperture 230, may be disposed. In some embodiments, the pressure release aperture 230 will be positioned in the wall 228 of the housing 212 proximate the second end 220 of the housing 212. The pressure release aperture 230 allows air or other gases to be bled or purged from the core sample tool 124 prior to deploying the core sample tool 124 downhole.

A core opening 232 is disposed in or proximate the first end 216 of the housing 212. The core opening 232 may have a cross-sectional shape similar to or the same as the cross-sectional shape of the passage 224. In the embodiment illustrated in FIG. 2, the core opening 232 has a circular cross-sectional shape, and a diameter of the core opening 232 is less than a diameter of the passage 224. A shoulder 236 is defined in the passage 224 near the first end 26 of the housing 212, and a width, w, of the shoulder 236 represents approximately half of a difference between the widths (e.g., diameters) of the passage 224 and the core opening 232.

A core piston 240 is movably and sealingly positioned in the core opening 232. A groove 244 or slot is disposed in a wall of the housing 212 defining the core opening 232. The groove 244 is capable of receiving a collet 248 or shear pin associated with the core piston 240. In an embodiment, the core piston 240 is held in a home position (see FIG. 2) and prevented from axial movement within the core opening 232 until an appropriate force is applied to the core piston 240. In some embodiments, the collet 248 and groove 244 simply prevent movement of the core piston 240 in a direction toward the first end 116 of the housing 212.

The second end 220 of the housing 212 includes an end wall 252 that may span the width of the passage 224 as illustrated in FIG. 2. An aperture 256 is disposed in the end wall 252 between the passage 224 and wellbore 104. More specifically, hydraulic communication or fluid communication may be provided between the passage 224 and the annulus 160 of the wellbore 104. Hydraulic or fluid communication allows equalization of pressure between fluid in the passage 224 and fluid in the wellbore 104.

A liner spacer 264 is disposed within the passage 224 of the housing 212 between the core opening 232 and the end wall 252. The liner spacer 264 may span the width of the passage 224 as illustrated in FIG. 2. An aperture 266 is disposed in the liner spacer 264 to allow fluid communication within the passage 224 between opposite sides of the liner spacer 264. A balancing piston 268 may be movably positioned within the passage 224 between the end wall 252 and the liner spacer 264. The balancing piston 268 may be capable in some embodiments of moving between the end wall 252 and the liner spacer 264. The balancing piston 268 may include a pressure release valve 270 disposed in the balancing piston 268 to allow equalization of fluid pressure across the balancing piston 268 in the event the pressure differential across the balancing piston 268 meets or exceeds a threshold value. In one embodiment, the threshold value may be 5-25 bars of pressure.

In some embodiments, a biasing member 272 may be positioned between the balancing piston 268 and the end wall 252 to exert a biasing force on the balancing piston 268 in a direction toward the liner spacer 264. In the embodiment illustrated in FIG. 2, the biasing member 272 is a compression spring. In some embodiments, the biasing member 272 may be omitted from the core sample tool 124. In others, the biasing member 272 may comprise an extension spring coupled to and positioned between the balancing piston 268 and the liner spacer 264. In still other embodiments, alternative springs or biasing members may be used as biasing member 272.

A sponge 280 is positioned within the passage 224 between the core opening 232 and the liner spacer 264. The sponge 280 may be a natural sponge or a synthetic sponge that may have a porosity or a plurality of open cells capable of receiving and retaining a fluid. The sponge 280 in some embodiments may be disposed circumferentially around a perimeter of the passage 224 such that the sponge 280 is positioned between, and in some cases even contacts, the shoulder 236 and the liner spacer 264. The positioning of the sponge 280 around the perimeter of the passage 224 prevents the sponge 280 from interfering with the movement of the core piston 240 as the core piston 240 moves into the passage 224 during collection of the core sample. For this reason, in some embodiments including that illustrated in FIG. 2, the sponge 280 has an inner width (e.g., diameter) that is no less than an outer width (e.g., diameter) of the core piston 240.

A sample chamber 284 is defined within the passage 224 between the balancing piston 268 and the core opening 232. An equalization chamber 288 is defined within the passage 224 between the balancing piston 268 and the end wall 252. Both the sample chamber 284 and the equalization chamber 288 are variable volume chambers, the volumes of which vary depending on the position of the balancing piston 268. In the embodiment illustrated in FIG. 2, the sample chamber 284 at a minimum volume includes that space within the passage 224 between the liner spacer 264 and the core opening 232. It should be noted, however, that in some embodiments, the liner spacer 264 may not be a part of the core sample tool 124.

In the embodiment illustrated in FIG. 2, a fill line 310 is positioned through the end wall 252, the balancing piston 268, and the liner spacer 264. The end wall 252 and liner spacer 264 may assist in securing the fill line 310 relative to the housing 212, and preferably the coupling between the fill line 310 and each of the end wall 252 and the liner spacer 264 is a sealed coupling. Such a coupling may be provided by a welded or braised connection, a sealed bulkhead-type fitting, or any other suitable coupling method. The fill line 310 passes through an aperture in the balancing piston 268, which permits reciprocal movement of the balancing piston 268 relative to the fill line 310 but also maintains a suitable sealed connection between the fill line 310 and the balancing piston 268, thereby preventing or substantially preventing fluid leakage between opposite sides of the balancing piston 268.

The fill line 310 includes a fill port 314 in fluid communication with the sample chamber 284 to allow a fluid to be added to the sample chamber prior to downhole deployment of the core sample tool 124. A valve 318 may be operably associated with the fill line 310 and positioned on an end of the fill line 310 opposite the fill port 314 to selectively allow or prevent filling of the sample chamber with the fluid.

Figure 6:
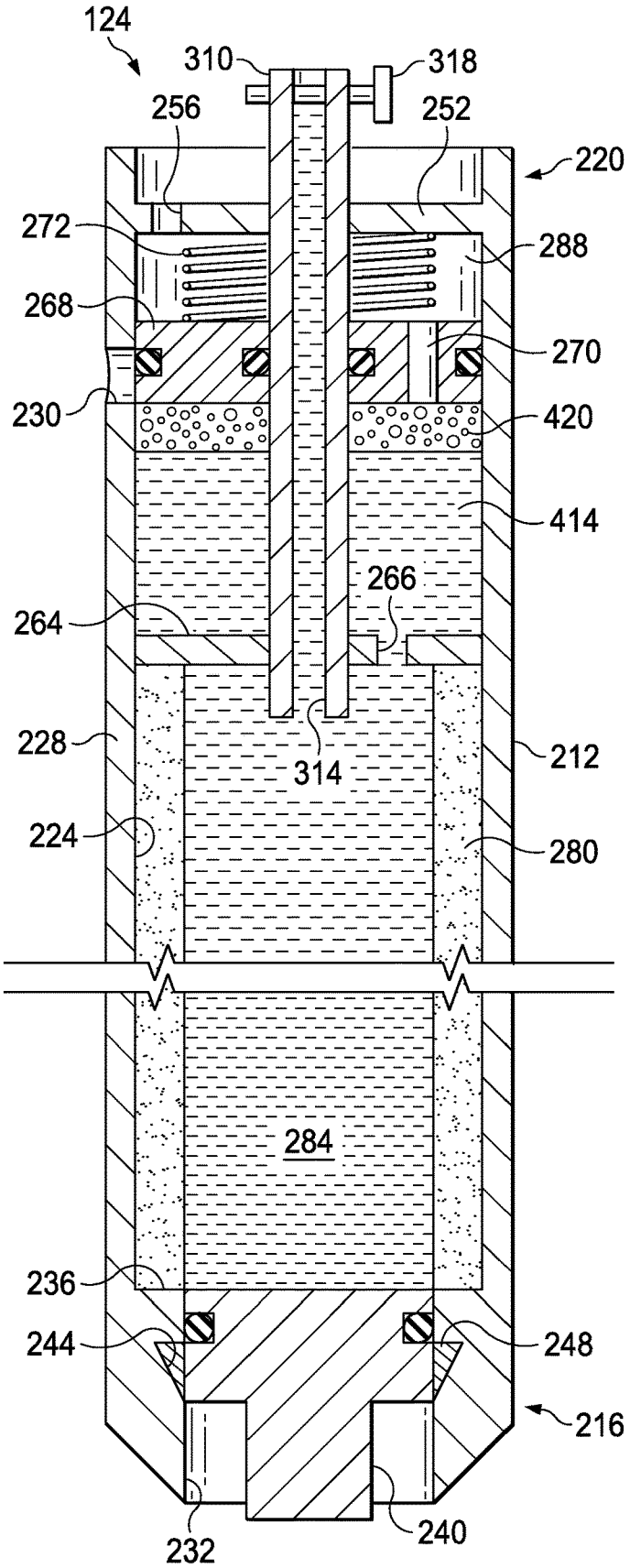
Figure 7:
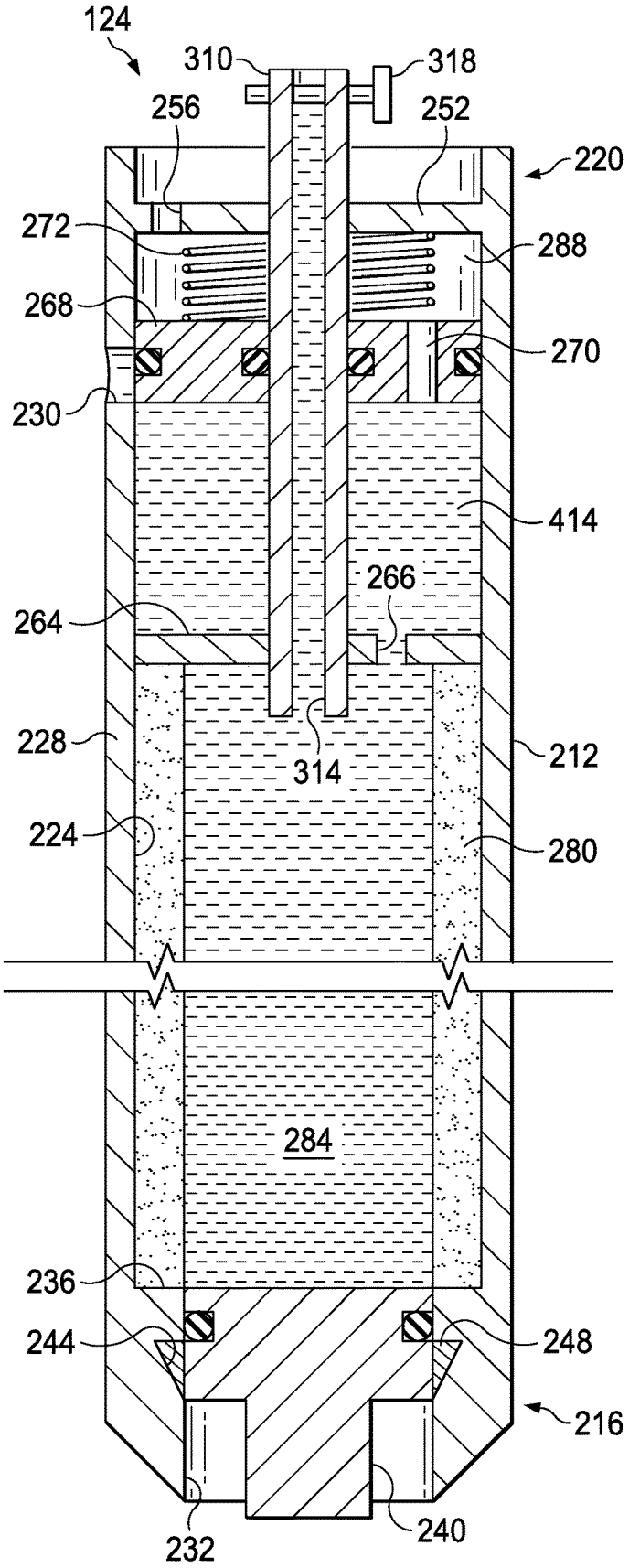
Figure 8:
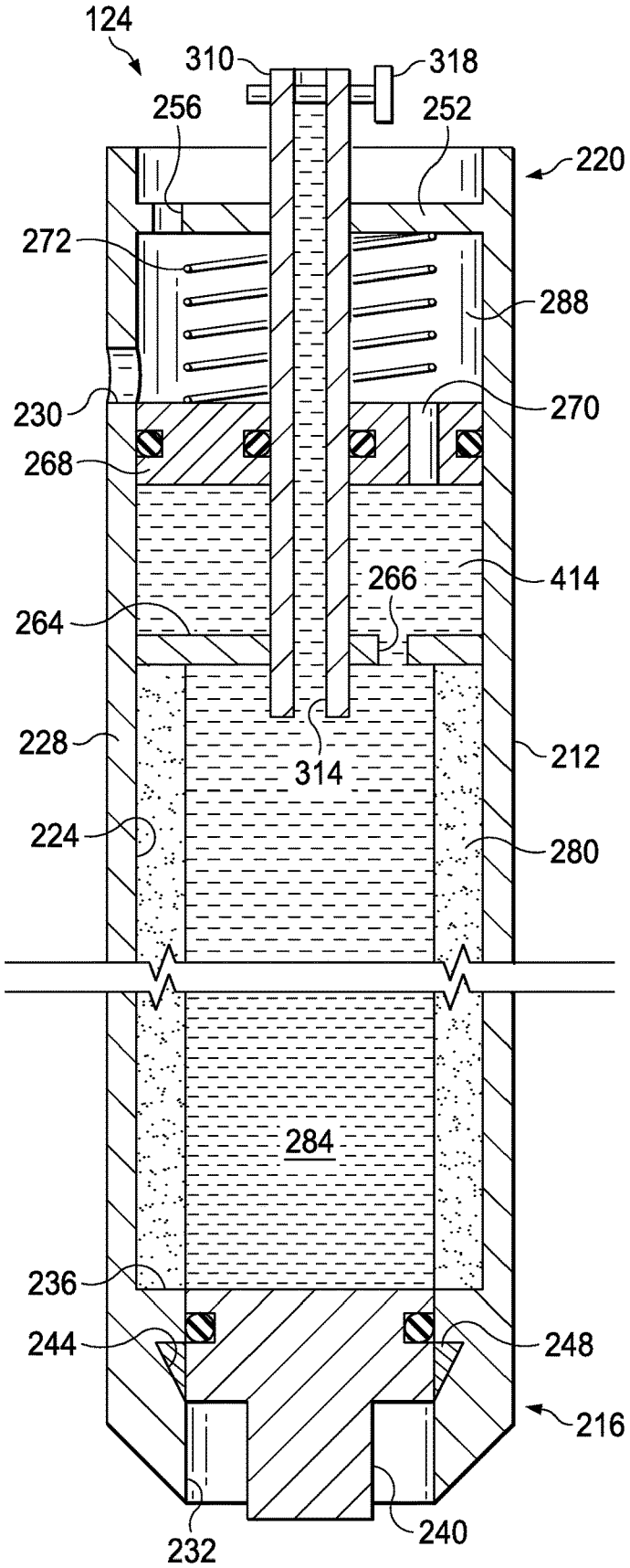
FIGS. 8-10 illustrate a cross-sectional front view of the core sample tool of FIG. 2 during sequential stages of trip in and coring operations.
Figure 9:
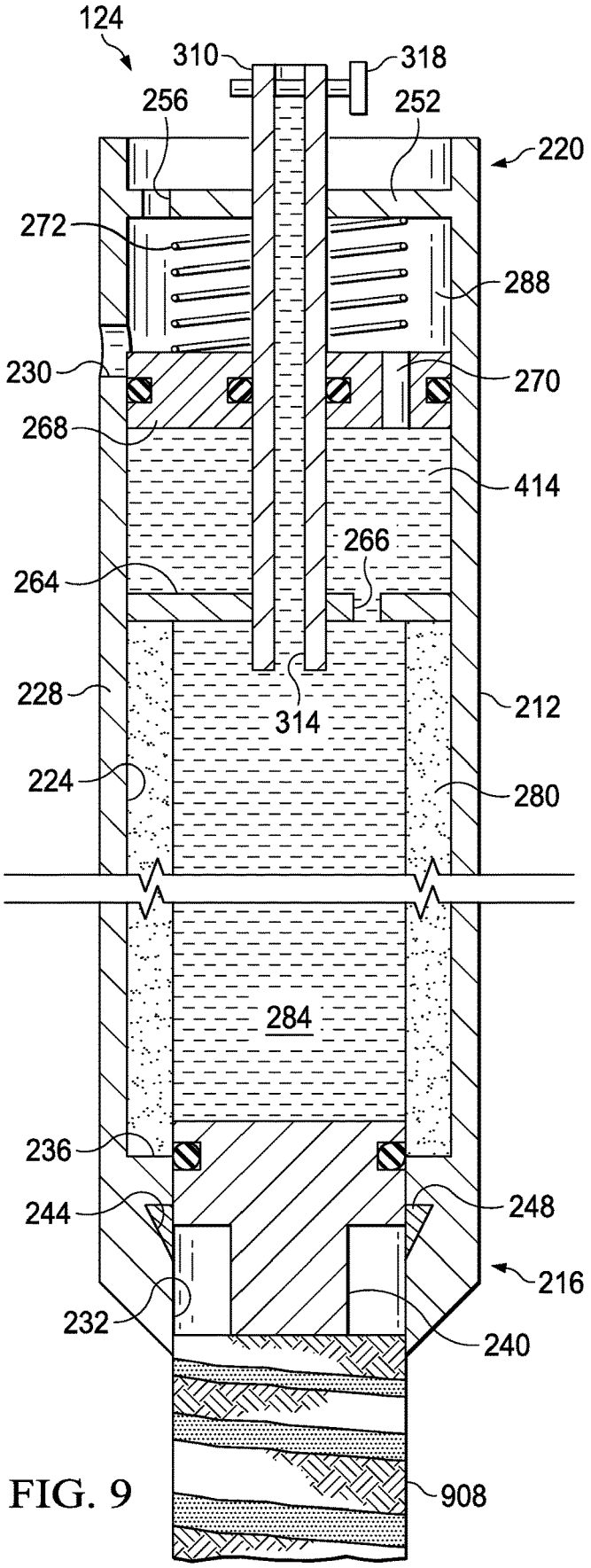
Figure 10:
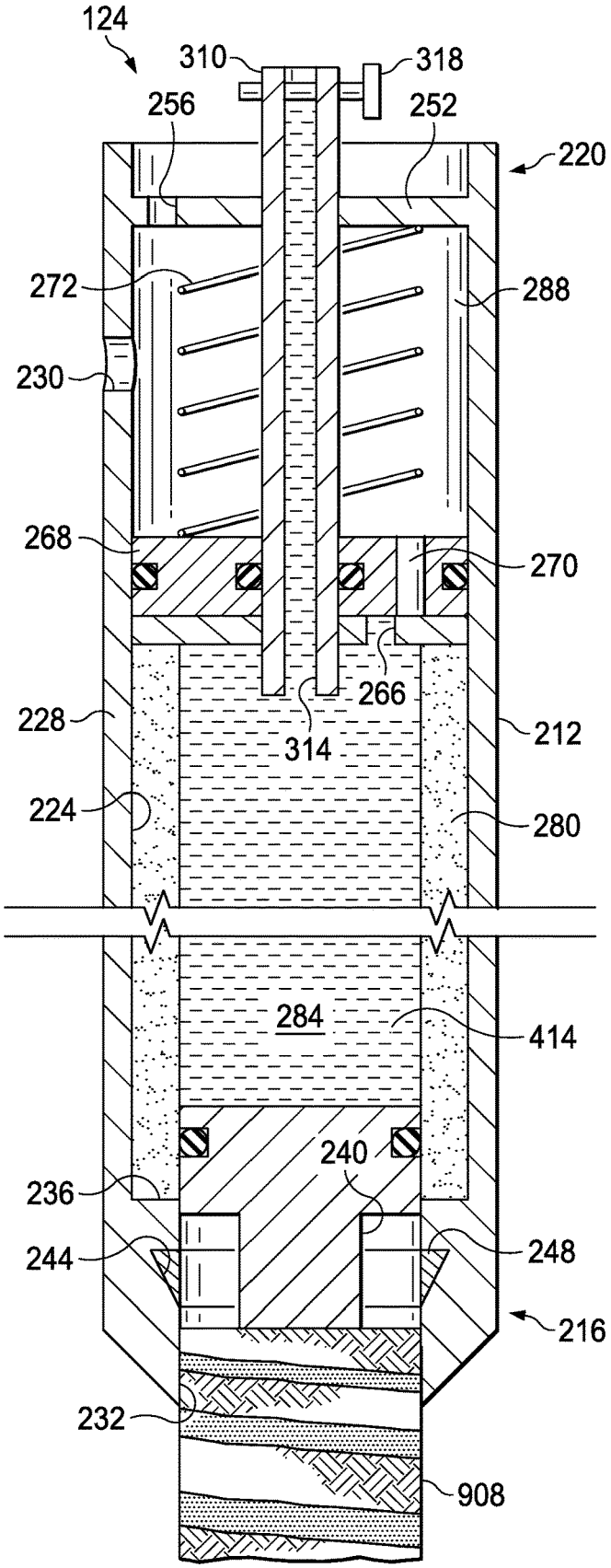

Referring now to FIGS. 3-10, the operation of the core sample tool 124 is described and illustrated in more detail. More specifically, FIGS. 3-7 illustrate a cross-sectional front view of the core sample tool 124 during sequential stages of preparation prior to delivery to a downhole location of a well. FIGS. 8-10 illustrate a cross-sectional front view of the core sample tool 124 during sequential stages of trip in and coring operations.

While preparing the core sample tool 124 for downhole delivery (FIGS. 3-7), the core sample tool 124 may be oriented in an "upright position" such that the first end 216 of the housing 212 is positioned lower than the second end 220 in relation to gravitational forces acting on the core sample tool 124. This orientation allows proper purging or bleeding of air and other gases from the device.

Figure 3:
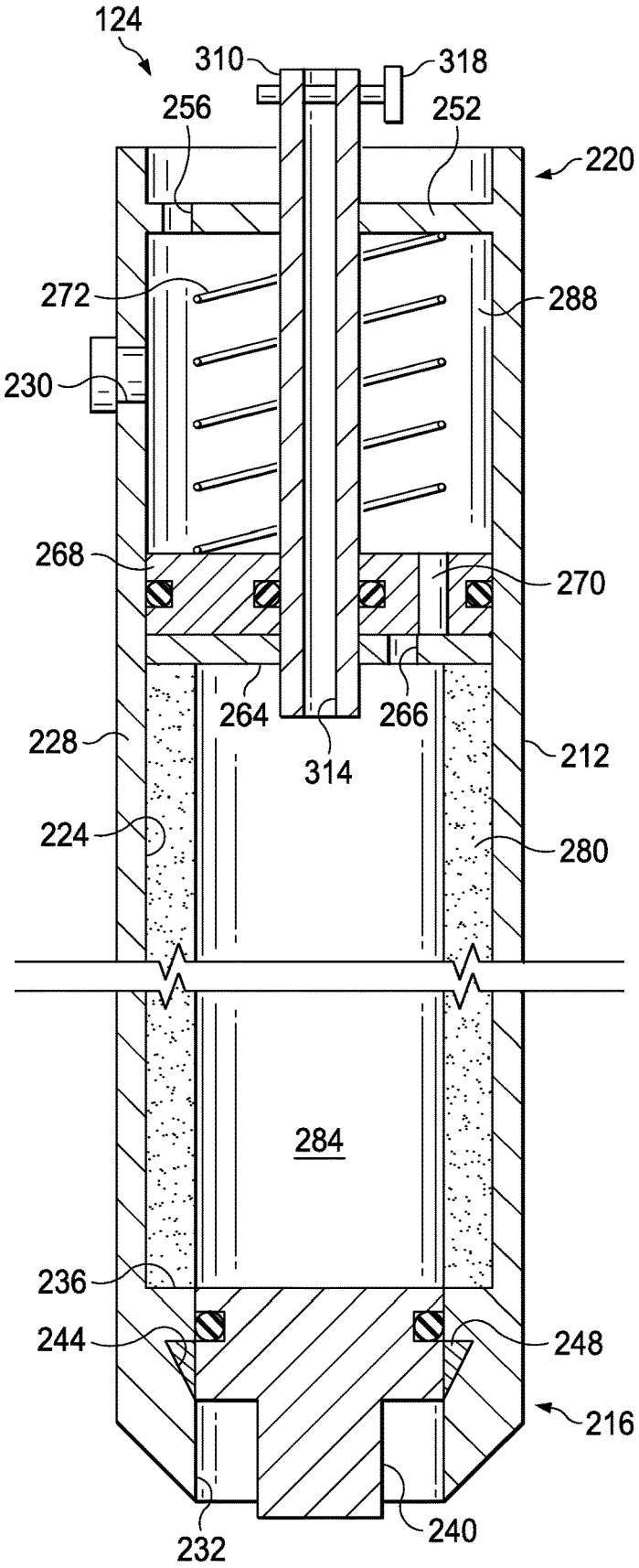
FIGS. 3-7 illustrate a cross-sectional front view of the core sample tool of FIG. 2 during sequential stages of preparation prior to delivery to a downhole location of a well.

In FIG. 3, the valve 318 of the fill line 310 is open and the core piston 240 is positioned and held in the home position. A vacuum or negative pressure is applied to the fill line 310 to evacuate air or other fluids from the sample chamber 284. A pressure of approximately 0.2 bar (absolute pressure) may be obtained within the sample chamber 284. As pressure within the sample chamber 284 reduces, the balancing piston 268 is moved into contact with the liner spacer 264. At this positioning of the balancing piston 268, the volume of the sample chamber 284 is minimized and the volume of the equalization chamber is maximized. At this position, the biasing member 272 may also be fully extended. While most of the air has been removed from the sample chamber 284 under the influence of the reduced pressure application through fill line 310, it is notable that some air may still be present within the cells of the sponge 280.

Figure 4:
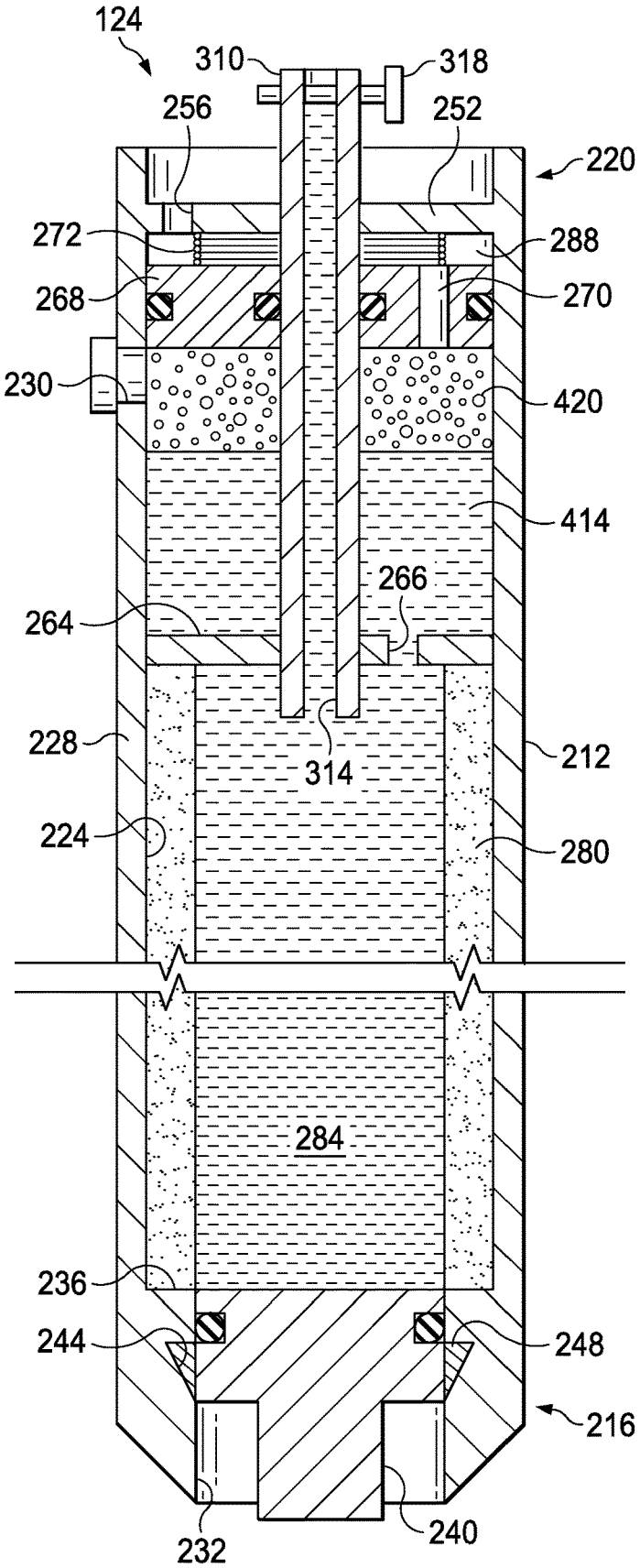

Referring now to FIG. 4, a brine solution or other fill fluid 414 is delivered to the sample chamber 284 through the fill line 310 until the amount of fill fluid 414 is sufficient to move the balancing piston 268 to a position in which the volume of the sample chamber 284 is maximized and the volume of the equalization chamber is minimized. At this positioning of the balancing piston 268, the biasing member 272 may be fully compressed. As fill fluid enters the sample chamber and is absorbed into the sponge 280, some air within the sponge 280 is displaced and rises through the aperture 266 and a gas layer 420 forms above the fill fluid 414. The valve 318 is closed following delivery of the fill fluid 414. Again, it is important to note that while the sponge 280 is substantially saturated with fill fluid 414, some air or gas may still be present within closed or open cells or pockets within the sponge 280. In one embodiment, the percentage of air may be approximately 20%, while the percentage of liquid is approximately 80%. After filling the sample chamber 284, the approximate pressure may be 20-25 bar in some embodiments. Following release of the pressure described below, the pressure within the sample chamber 284 may be approximately 5 bar in some embodiments.

Figure 5:
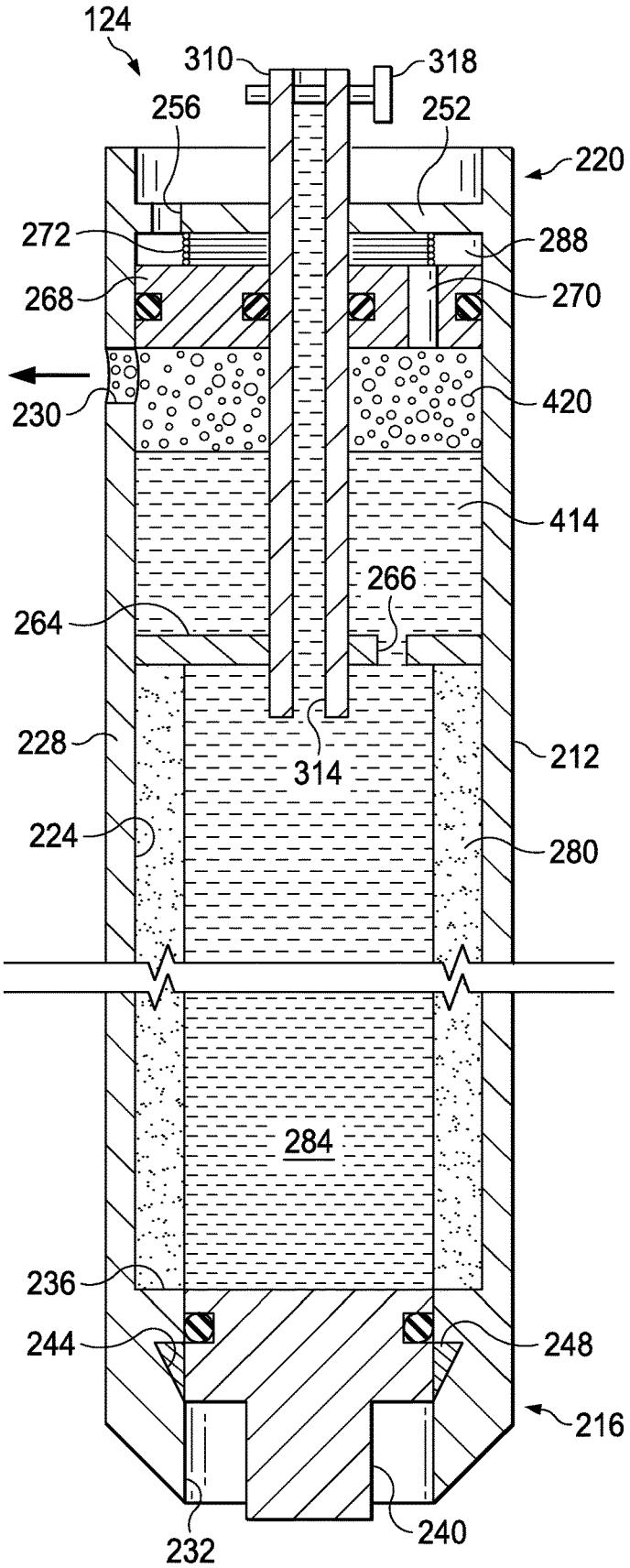

Referring to FIG. 5, the pressure release aperture 230 in the wall 228 of the housing 212 may be opened to bleed, purge or otherwise release air or other gases (i.e. the gas layer 420) from the sample chamber 284. Referring to FIG. 6, as gas is released through the pressure release aperture 230, the balancing piston 268 moves in the direction of the liner spacer 264 until the balancing piston 268 approximately reaches the pressure release aperture 230. Referring to FIG. 7, the valve 318 of the fill line 310 is again opened and additional fill fluid 414 is added to the sample chamber 284 until fill fluid 414 begins to exit the pressure release aperture 230. At this point, the gas from the gas layer 420 has been removed from the sample chamber 284, and the pressure release aperture 230 is again closed. Following the step of filling the sample chamber 284 with fill fluid 414, the pressure of the fill fluid 414 within the sample chamber 284 is equal to the biasing force exerted by the biasing member 272 divided by the surface area of the balancing piston 268.

Referring now to FIG. 8, the core sample tool 124 may be tripped into the wellbore 104 for delivery to the downhole location 126. As the core sample tool 124 trips in, the pressure of wellbore fluid in the annulus 160 increases. The aperture 256 of the end wall 252 allows fluid communication or hydraulic communication between the equalization chamber 288 and the wellbore fluid in the annulus 160. This permits changes in wellbore pressures to be communicated via the balancing piston 268 to the sample chamber 284. Since the pressure of the fill fluid 414 in the sample chamber 284 approximately equals that of fluid in the wellbore 104, pressures across the core piston 240 remain relatively balanced. This balance of pressure across the core piston 240 prevents the core piston 240 from moving into the sample chamber 284 during trip in, which prevents contamination of the sample chamber 284 prior to core sample extraction. The presence of the sponge 280 is also important since the presence of some gases (e.g., air) within the sponge 280 allows for some compressibility within the sample chamber 284. As the pressure increases in the equalization chamber 288 during trip in, the balancing piston 268 moves toward the liner spacer 264 as the pressure increases in the sample chamber 284 and the volume of the sponge 280 is decreased.

Referring to FIG. 9, when core sample tool 124 arrives at the downhole location 126 and coring commences, a core sample 908 exerts a force on the core piston 240 toward the sample chamber 284. As the sealing ability of the core piston 240 remains intact (see FIG. 9), the force applied on the core piston 240 by the core sample 908 is approximately equal to the force required to move the biasing member 272 (e.g., compress the spring). Referring now to FIG. 10, as the sealing ability of the core piston 240 is lost, the biasing member 272 forces the balancing piston 268 toward the liner spacer 264, which pushes some of the fill fluid 414 from the sample chamber 284. The core sample 908 then moves into the sample chamber 284, which has been protected from contamination.

Obtaining core samples within a well is important to understanding the composition and properties of the rock, strata, and other substrate in which the well is formed. While collecting core samples, it is desired to minimize contamination of sampling tools so that the core samples obtained may be accurately evaluated. The present disclosure describes systems, tools, and methods for obtaining core samples from a wellbore. In addition to the embodiments described above, many examples of specific combinations are within the scope of the disclosure, some of which are detailed below.

Example 1

A system for obtaining a core sample from a wellbore, the system comprising:

- a housing having a core opening at a first end of the housing and an end wall at a second end of the housing;
- a balancing piston positioned within the housing to define a sample chamber between the balancing piston and the core opening and an equalization chamber between the balancing piston and the end wall; and
- a core piston sealingly positioned in the core opening.

Example 2

The system of example 1 further comprising a sponge positioned within the sample chamber.

Example 3

The system of example 2, wherein the sponge is disposed around a perimeter of the passage, the sponge having an inner width that is no less than an outer width of the core piston.

Example 4

The system of any of examples 1-3 further comprising:

- a biasing member positioned between the balancing piston and the end wall to exert a biasing force on the balancing piston in a direction of the sample chamber.

Example 5

The system of any of examples 1-4 further comprising a liquid disposed within the sample chamber.

Example 6

The system of any of examples 1-5, wherein the equalization chamber is hydraulically coupled to a fluid in the wellbore such that a pressure of the fluid is transmitted to the balancing piston and the sample chamber.

Example 7

The system of example 6, wherein the equalization chamber is fluidly coupled to the fluid in the wellbore.

Example 8

The system of any of examples 1-7 further comprising:

- a fill port operably associated with the sample chamber and capable of adding a fluid to the sample chamber; and
- a pressure release operably associated with the sample chamber and capable of bleeding air from the sample chamber.

Example 9

A system for obtaining a core sample from a wellbore, the system comprising:

- a tubing member having a first end, a second end, and a passage extending between the first and second ends, the first end of the tubing member having a core opening, the second end of the tubing member having an end wall;
- a liner spacer disposed within the passage between the core opening and the end wall;
- a balancing piston movably positioned between the end wall and the liner spacer;
- a biasing member positioned between the balancing piston and the end wall to exert a biasing force on the balancing piston in a direction toward the liner spacer;
- a core piston sealingly positioned in the core opening, the core piston being prevented from moving within the core opening in a direction opposite the liner spacer, the core piston being allowed to move within the core opening in a direction toward the liner spacer;
- a sponge positioned within the passage between the core opening and the liner spacer, the sponge being disposed around a perimeter of the passage, the sponge having an inner width that is no less than an outer width of the core piston.

Example 10

The system of example 9 further comprising:

- a sample chamber defined within the passage between the balancing piston and the core opening; and
- an equalization chamber defined within the passage between the balancing piston and the end wall.

Example 11

The system of examples 9 or 10 further comprising a liquid disposed within the sample chamber.

Example 12

The system of any of examples 9-11, wherein the equalization chamber is hydraulically coupled to a fluid in the wellbore such that a pressure of the fluid is transmitted to the balancing piston and the sample chamber.

Example 13

The system of any of examples 9-12 further comprising an aperture in the end wall to allow fluid communication between the equalization chamber and the wellbore.

Example 14

The system of any of examples 9-13 further comprising:

a fill line positioned through the end wall, the balancing piston, and the liner spacer, the fill line having a fill port in fluid communication with the sample chamber to allow a fluid to be added to the sample chamber; and a pressure release aperture disposed in a wall of the tubing member between the end wall and the liner spacer, the pressure release aperture allowing air to be purged from the sample chamber.

Example 15

The system of example 14 further comprising a valve operably associated with the fill line to selectively allow or prevent filling of the sample chamber with the fluid.

Example 16

The system of any of examples 9-15 further comprising a pressure release valve disposed in the balancing piston to allow equalization of fluid pressure across the balancing piston.

Example 17

A method for obtaining a core sample from a wellbore, the method comprising:

providing a housing having a sample chamber capable of receiving the core sample from a downhole location;

as the housing is delivered downhole, adjusting the pressure of a fill fluid in the sample chamber to approximate a pressure of a wellbore fluid in the wellbore; and preventing entry of wellbore fluid into the sample chamber as the housing is delivered to the downhole location.

Example 18

The method of example 17 further comprising:

prior to delivering the housing downhole, filling the sample chamber with the fill fluid and bleeding air from the sample chamber.

Example 19

The method of examples 17 or 18, wherein adjusting the pressure of fill fluid in the sample chamber further comprises:

moving a piston in response to the pressure of the wellbore fluid.

Example 20

The method of any of examples 17-19 further comprising:

collecting the core sample in the sample chamber when the housing is delivered to the downhole location.

It should be apparent from the foregoing that embodiments of an invention having significant advantages have been provided. While the embodiments are shown in only a few forms, the embodiments are not limited but are susceptible to various changes and modifications without departing from the spirit thereof.

We claim:

1. A system for obtaining a core sample from a wellbore, the system comprising:

a housing having a core opening at a first end of the housing, an end wall at a second end of the housing, and a side wall coupling the first end and the end wall;

a liner spacer positioned within the housing to define a sample chamber between the liner spacer and the core opening;

a balancing piston movably positioned within the housing between the liner spacer and the end wall to form a fluid chamber between the liner spacer and the balancing piston and an equalization chamber between the balancing piston and the end wall such that the equalization chamber and fluid chamber are variable volume chambers, the fluid chamber fluidically coupled to the sample chamber;

a pressure release aperture disposed in the side wall to purge a gas from the equalization chamber; and a core piston sealingly positioned in the core opening.

2. The system of claim 1 further comprising a sponge positioned within the sample chamber.

3. The system of claim 2, wherein the sponge is disposed around a perimeter of the passage, the sponge having an inner width that is no less than an outer width of the core piston.

4. The system of claim 1 further comprising:

a biasing member positioned between the balancing piston and the end wall to exert a biasing force on the balancing piston in a direction of the sample chamber.

5. The system of claim 1 further comprising a liquid disposed within the sample chamber.

6. The system of claim 1, wherein the equalization chamber is hydraulically coupled to a fluid in the wellbore such that a pressure of the fluid is transmitted to the balancing piston and the sample chamber.

7. The system of claim 6, wherein the equalization chamber is fluidly coupled to the fluid in the wellbore.

8. The system of claim 1 further comprising:

a fill port operably associated with the sample chamber and capable of adding a fluid to the sample chamber.

9. A system for obtaining a core sample from a wellbore, the system comprising:

a tubing member having a first end, a second end, a side wall coupling the first end and the second end, and a passage extending between the first and second ends, the first end of the tubing member having a core opening, the second end of the tubing member having an end wall;

a liner spacer disposed within the passage between the core opening and the end wall to define a sample chamber between the liner spacer and the core opening;

a balancing piston movably positioned between the end wall and the liner spacer to form a fluid chamber between the liner spacer and the balancing piston and an equalization chamber between the balancing piston and the end wall such that the equalization chamber and fluid chamber are variable volume chambers, the fluid chamber fluidically coupled to the sample chamber;

a pressure release aperture disposed in the side wall to purge a gas from the equalization chamber;

a biasing member positioned between the balancing piston and the end wall to exert a biasing force on the balancing piston in a direction toward the liner spacer;

a core piston sealingly positioned in the core opening, the core piston being prevented from moving within the core opening in a direction opposite the liner spacer, the core piston being allowed to move within the core opening in a direction toward the liner spacer; and a sponge positioned within the passage between the core opening and the liner spacer, the sponge being disposed around a perimeter of the passage, the sponge having an inner width that is no less than an outer width of the core piston.

10. The system of claim 9 further comprising:

a sample chamber defined within the passage between the balancing piston and the core opening; and an equalization chamber defined within the passage between the balancing piston and the end wall.

11. The system of claim 10 further comprising a liquid disposed within the sample chamber.

12. The system of claim 10, wherein the equalization chamber is hydraulically coupled to a fluid in the wellbore such that a pressure of the fluid is transmitted to the balancing piston and the sample chamber.

13. The system of claim 10 further comprising an aperture in the end wall to allow fluid communication between the equalization chamber and the wellbore.

14. The system of claim 10 further comprising:

a fill line positioned through the end wall, the balancing piston, and the liner spacer, the fill line having a fill port in fluid communication with the sample chamber to allow a fluid to be added to the sample chamber.

15. The system of claim 14 further comprising a valve operably associated with the fill line to selectively allow or prevent filling of the sample chamber with the fluid.

16. The system of claim 9 further comprising a pressure release valve disposed in the balancing piston to allow equalization of fluid pressure across the balancing piston.

17. A method for obtaining a core sample from a wellbore, the method comprising:

providing a housing, the housing including:

a core opening at a first end of the housing, an end wall at a second end of the housing, a side wall coupling the first end and the end wall, and a liner spacer positioned within the housing to define a sample chamber between the liner spacer;

a balancing piston movably positioned within the housing between the liner spacer and the end wall to form a fluid chamber between the liner spacer and the balancing piston and an equalization chamber between the balancing piston and the end wall such that the equalization chamber and fluid chamber are variable volume chambers, the fluid chamber fluidically coupled to the sample chamber;

as the housing is delivered downhole, adjusting the pressure of a fill fluid in the sample chamber to approximate a pressure of a wellbore fluid in the wellbore;

purging gas from the equalization chamber via a pressure release aperture disposed in the side wall; and preventing entry of a wellbore fluid into the sample chamber as the housing is delivered to the downhole location.

18. The method of claim 17 further comprising:

prior to delivering the housing downhole, filling the sample chamber with the fill fluid and bleeding air from the sample chamber.

19. The method of claim 17 wherein adjusting the pressure of the fill fluid in the sample chamber further comprises:

moving a piston in response to the pressure of the wellbore fluid.

20. The method of claim 17 further comprising:

collecting the core sample in the sample chamber when the housing is delivered to the downhole location.

* * * * *